US007383014B2

(12) United States Patent
Baker et al.

(10) Patent No.: US 7,383,014 B2
(45) Date of Patent: Jun. 3, 2008

(54) AUGER FOR USE WITHIN AN IMAGE FORMING DEVICE

(75) Inventors: Christopher Lee Baker, Salvisa, KY (US); Derek Masami Inouye, Lexington, KY (US); Larry Steven Foster, Lexington, KY (US); Lenci Robert Kappes, Lexington, KY (US); Donn Duane Bryant, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 166 days.

(21) Appl. No.: 11/150,570

(22) Filed: Jun. 10, 2005

(65) Prior Publication Data

US 2006/0280532 A1 Dec. 14, 2006

(51) Int. Cl.
*G03G 21/00* (2006.01)

(52) U.S. Cl. ..... 399/358; 399/359; 399/360

(58) Field of Classification Search ..... 399/160, 399/358, 359, 360

See application file for complete search history.

(56) References Cited

U.S. PATENT DOCUMENTS 3,950,092 A * 4/1976 Zoltner ..... 399/358
4,650,312 A 3/1987 Vineski
4,659,212 A * 4/1987 Ichihara et al. ..... 399/358
4,819,578 A 4/1989 Koiso et al.
4,974,031 A 11/1990 Koiso et al.
5,113,227 A 5/1992 Miyasaka
5,130,756 A 7/1992 Taniyama
5,708,952 A 1/1998 Taniguchi et al.
5,715,502 A 2/1998 Taniguchi et al.
6,014,541 A 1/2000 Kato et al.
6,055,405 A 4/2000 Knott et al.
6,085,062 A 7/2000 Mizuishi et al.
6,266,511 B1 7/2001 Murakami et al.
6,418,297 B1 7/2002 Yamatani et al.
6,463,254 B1 10/2002 Maul et al.
6,968,139 B2 * 11/2005 Ban et al. ..... 399/106
7,085,507 B2 * 8/2006 Cook et al. ..... 399/35
7,149,467 B2 * 12/2006 Stickler et al. ..... 399/358
2005/0013633 A1 * 1/2005 Harumoto ..... 399/258

* cited by examiner

*Primary Examiner*—David M. Gray
*Assistant Examiner*—David A Blackshire
(74) *Attorney, Agent, or Firm*—Coats & Bennett, P.L.L.C.

(57) ABSTRACT

Embodiments for a toner auger for use in an image forming device. The image forming device includes a channel through which toner is moved. The auger is positioned within the channel and has an axis of rotation and at least one offset section extending radially outward from the axis of rotation. The offset section forms a sweep envelope that extends outward from the axis of rotation. The auger may be positioned within the channel for the offset to contact the channel. Contact may cause a vibratory force that prevents the toner from clogging and bridging within the channel.

22 Claims, 7 Drawing Sheets

AUGER FOR USE WITHIN AN IMAGE FORMING DEVICE

BACKGROUND

During the image forming process, inefficiencies from the photoconductive member to the media create waste toner. This may include toner that has been applied to a photoconductive member but not transferred to a media sheet or belt, or toner that is applied to a belt but not transferred to the media sheet. This waste toner should be removed and transported away to prevent print quality problems. The waste toner may be stored at a variety of locations. Previous devices have stored the waste toner in an area adjacent to image formation area. Other designs transport the waste toner from the image formation area to a remote area within the device.

Regardless of the location of the waste toner reservoir, the waste toner is conveyed from the location where the waste toner is removed from the photoconductive member or belt to the waste toner reservoir. The path for moving the waste toner is usually an enclosed conduit having a reduced cross-sectional size. The cross-sectional size of the path is often kept as small as possible in an attempt to keep the overall size of the image forming device to a minimum. The physical properties of the waste toner and the pathway have caused issues in the ability to move the waste toner to the waste toner reservoir. In one instance, the waste toner accumulates within the pathway and forms a bridge that blocks additional toner from being transported through the pathway. Instead of passing through the pathway, the waste toner backs up and may ultimately leak into the image formation area.

SUMMARY

The present invention relates to embodiments for a waste toner auger for use in an image forming device. The auger is positioned within a channel to move toner within the image forming device. The auger has an axis of rotation and at least one offset section. The offset section forms a sweep envelope that extends outward from the axis of rotation. The auger may be positioned within the channel for the offset to contact the channel. Contact may cause a vibratory force that prevents the toner from clogging and bridging within the channel.

DETAILED DESCRIPTION

Figure 1:
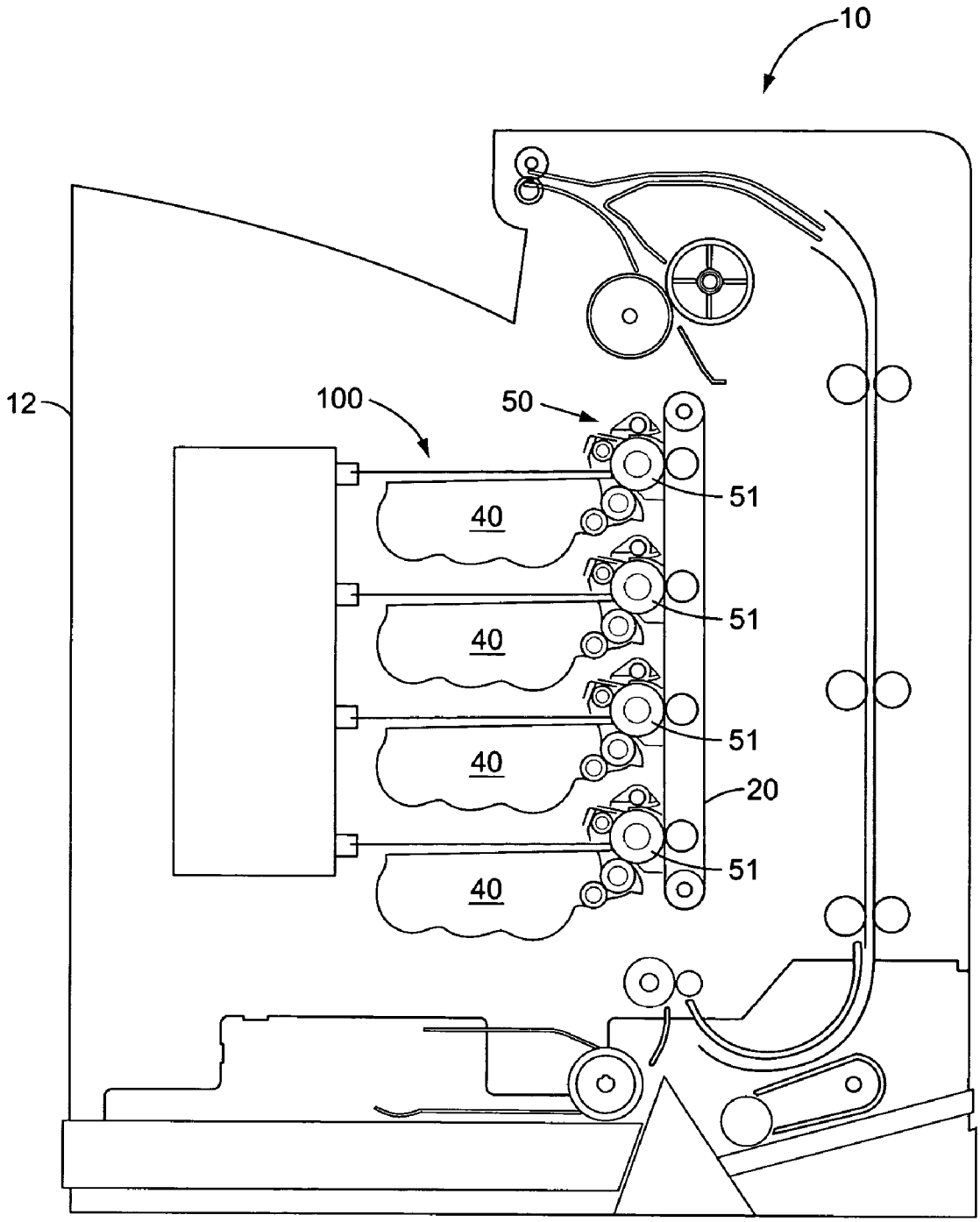
FIG. 1 is a schematic view of an image forming device according to one embodiment of the present invention.

For purposes of explanation of the basics of image formation, FIG. 1 illustrates the general elements of one embodiment of an image forming device 10. The representative image forming device 10 comprises a main body 12 with one or more image forming units 100. Color image forming devices typically include four image forming units 100 for printing with cyan, magenta, yellow, and black toner to produce a four-color image on the media sheet. In this embodiment, each image forming unit 100 comprises a developer section 40 and a photoconductive section 50. Toner is originally stored within the developer section 40 and is ultimately moved to a photoconductive member 51 within the photoconductive section 50. The toner image on the photoconductive member 51 is then transferred to a media sheet moving along a transport belt 20.

Figure 2:
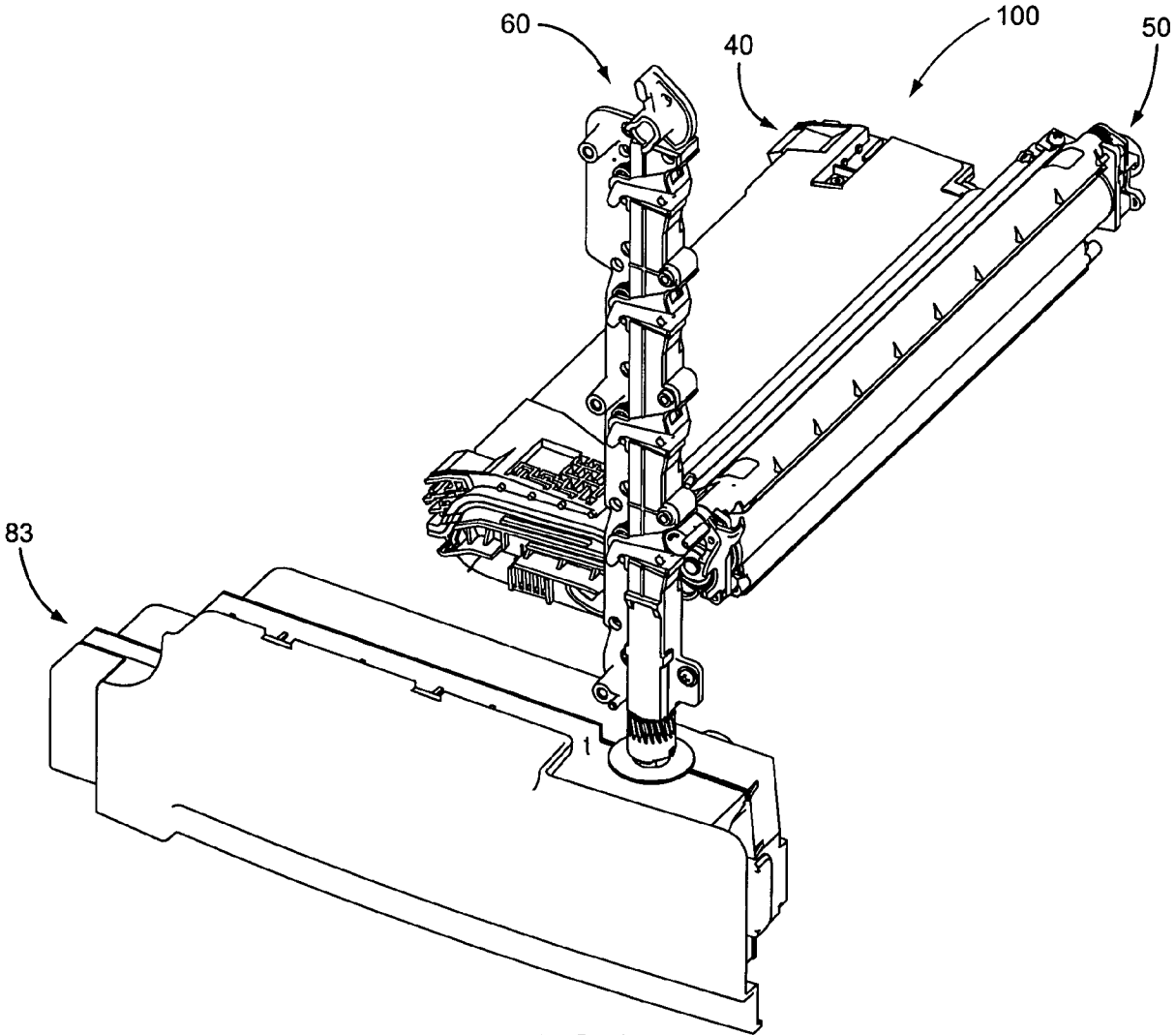
FIG. 2 is a partial perspective view illustrating elements of the waste toner system according to one embodiment of the present invention.

Following the image forming process, residual waste toner is moved from the photoconductive section 50 through a waste toner system as illustrated in FIG. 2. The waste toner system comprises a toner chute 60 and a waste toner reservoir 83. For simplicity, FIG. 2 illustrates a single image forming unit 100 attached to the toner chute 60. For a color image forming device, three additional image forming units 100 may also be attached to the toner chute 60. The waste toner from the photoconductive section 50 is moved into the toner chute 60 and ultimately deposited within the reservoir 83. Each of the photoconductive sections 50 and toner chute 60 include waste toner pathways that may experience toner bridging and clogging during toner movement. This bridging and clogging may prevent the waste toner from ultimately reaching the waste toner reservoir 83.

Figure 3:
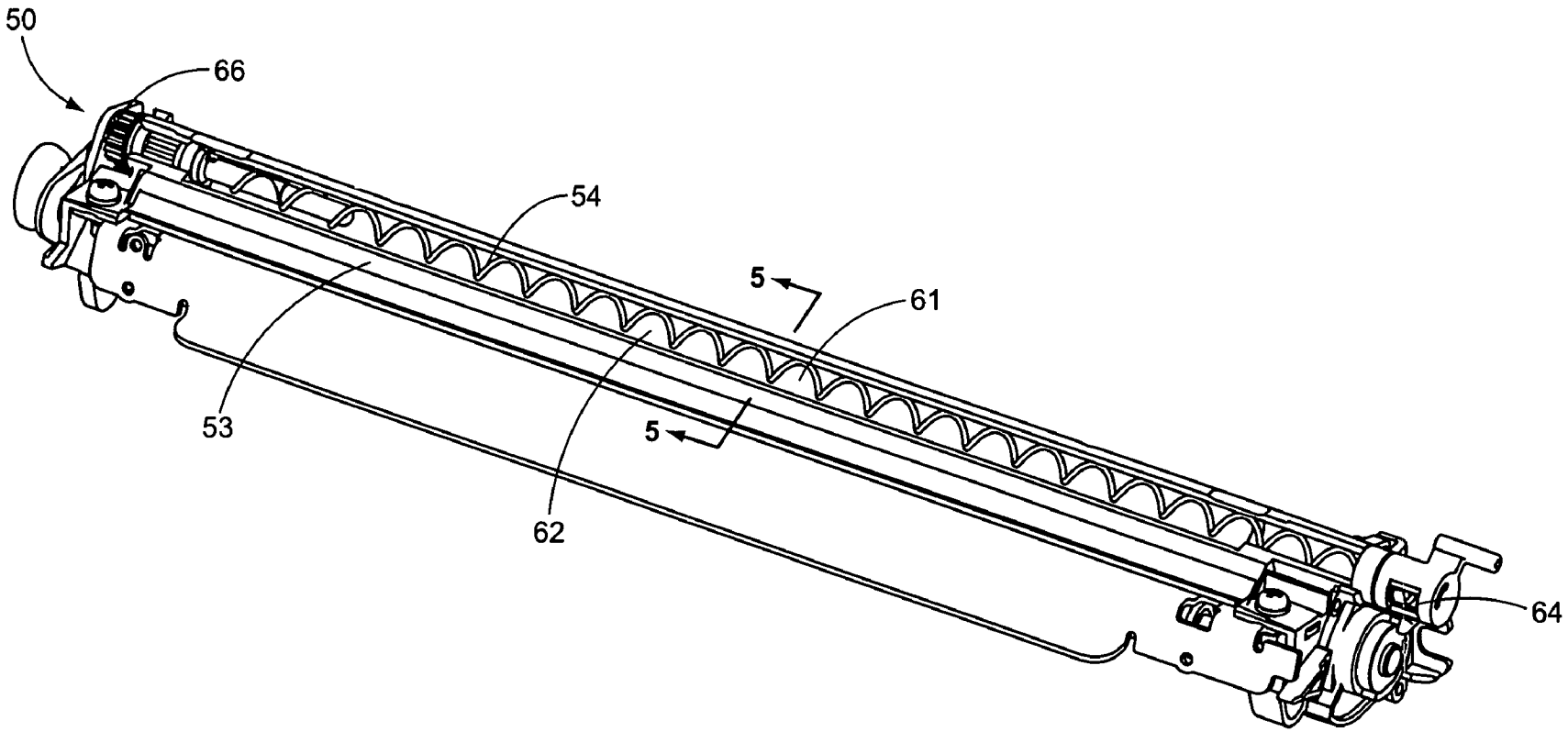
FIG. 3 is a partial cut-away perspective view illustrating a section of the waste toner system according to one embodiment of the present invention.

FIG. 3 illustrates an interior portion of the photoconductive section 50. A cleaner blade 53 removes residual toner from the photoconductive drum (not shown) and deposits the residual toner into an interior channel 61 of a cleaner housing 62. An auger 54 is positioned within the interior channel 61 to move the waste toner along the interior channel 61 and through a port 64 into the toner chute 60. The auger 54 may be affixed at one end to a drive gear 66. The drive gear 66 is driven by a motor within the main body 12 to rotate the auger 54 and moves the waste toner towards the port 64 and into the toner chute 60.

Figure 4:
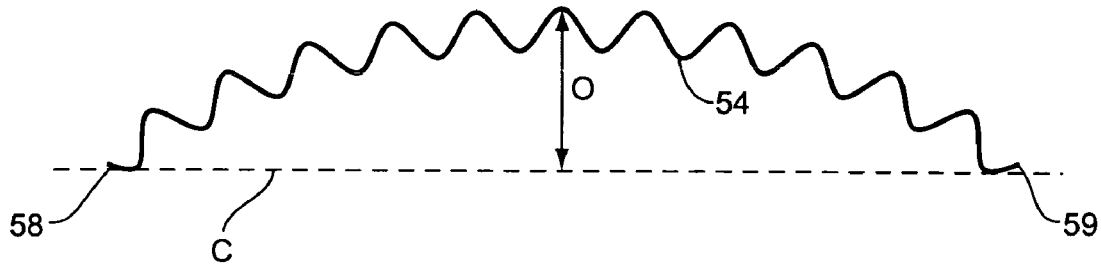
FIG. 4 is a schematic view illustrating a waste toner auger according to one embodiment of the present invention.

FIG. 4 illustrates one embodiment of an auger 54 used for moving the waste toner. The auger 54 has an elongated length with a helical configuration. In this embodiment, the auger 54 has a curved shape that is offset from a centerline C of an axis of rotation. The offset O varies along the length from no offset at the ends 58, 59, to a maximum offset at a central area. The amount of offset may be measured from the centerline C to a variety of locations on the auger (e.g., center, outer edge, inner edge). During rotation, the auger 54 has a sweep envelope S that varies along the axial length of the auger as a function of the amount of offset O. In the embodiment of FIG. 4, the sweep envelope S is two times the amount of offset O. In one embodiment, the centerline C of the auger 54 and the channel are both substantially linear.

Figure 5:
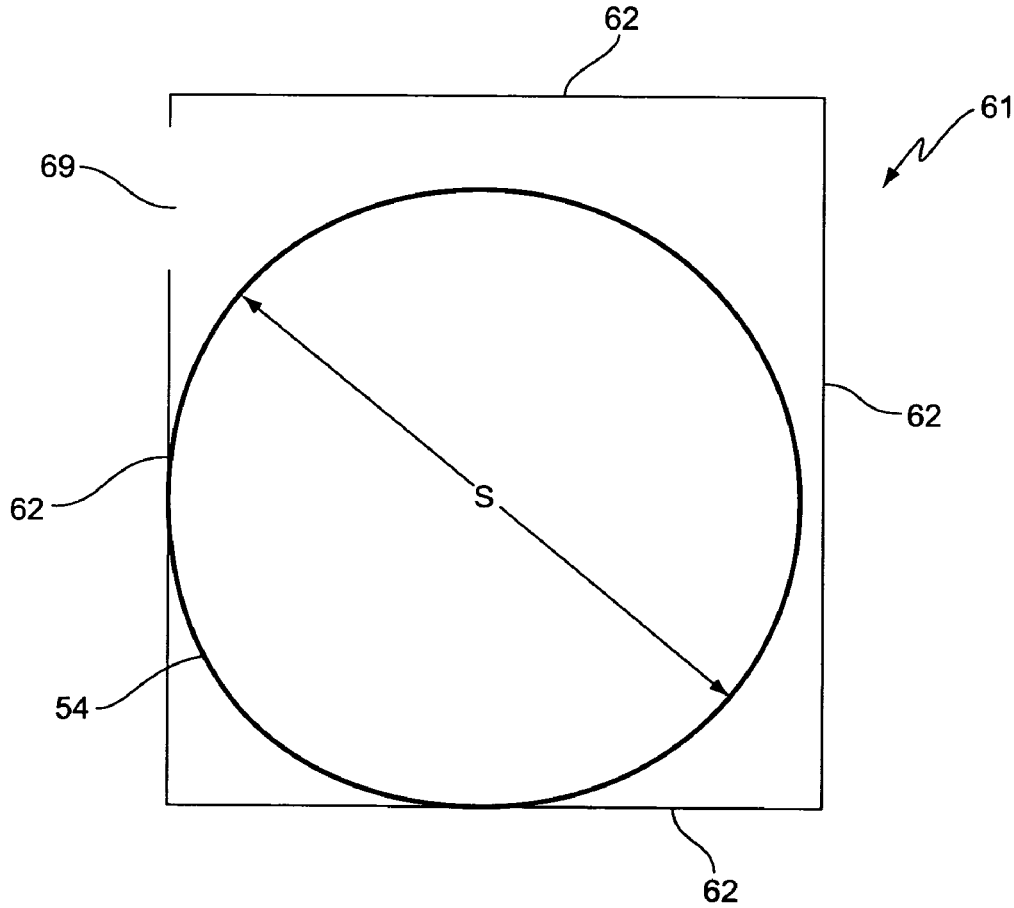
FIG. 5 is a cross-sectional view illustrating an auger within a housing according to one embodiment of the present invention.

The auger 54 rotates within the interior channel 61 to move toner along the length of the photoconductive section 50. FIG. 5 is a cross-sectional view cut along line 5-5 of FIG.

3 illustrating the interior channel 61 and auger 54. The interior channel 61 is formed by sidewalls 62 and may include an opening 69 to receive the waste toner that is removed from the photoconductive member 51. In this embodiment, the auger 54 is positioned for the offset to contact the interior channel 61 at two locations. The other axial sections of the auger 54 have smaller sweep envelopes S and therefore do not contact the interior channel 61.

The position of the auger 54 and the offset O brings the central area of the auger 54 into contact against the sidewalls 62 during rotation. This contact may, even if only momentarily, interrupt the rotation of the waste toner auger 54. During this interruption, drive gear 66 may continue to apply a rotational force to the auger 54. The applied rotational force may build a mechanical force within the waste toner auger 54. This force may be released when the built force overcomes any friction between the waste toner auger 54 and the interior channel 61. Upon release of the built force, the auger 54 may rotationally accelerate, and then may resume normal rotation speed. This vibratory force, in conjunction with the rotating auger 54, causes the accumulated waste toner to continually break apart, preventing bridging and clogging of the waste toner as it is transported along the waste toner conveyance path.

During a single revolution of the waste toner auger 54 there may be numerous contact, force build and force release cycles along an axial section of the interior channel 61. The embodiment of FIG. 5 includes two points of contact (i.e., the left and lower sidewalls 62 as viewed in FIG. 5). Further, the auger 54 may be shaped for one or more axial contact points along the length. The embodiment of FIG. 5 illustrates one axial contact, although more points may be used depending upon the application.

Figure 6:
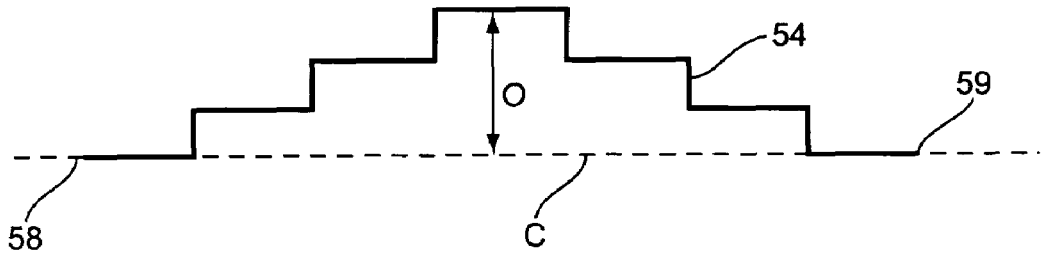
FIG. 6 is a schematic view illustrating a waste toner auger according to one embodiment of the present invention.
Figure 7:
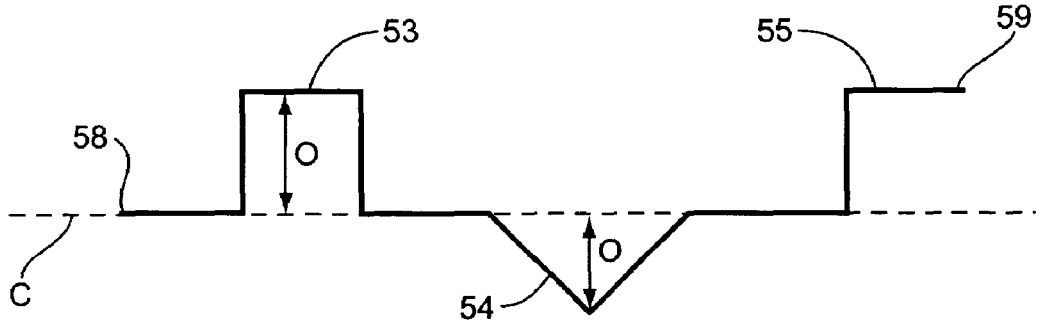
FIG. 7 is a schematic view illustrating a waste toner auger according to one embodiment of the present invention.

The auger 54 may have a variety of different shapes. FIG. 6 illustrates another embodiment having a stepped configuration with an offset O from the centerline C that increases towards a central area. FIG. 7 illustrates another embodiment having a variety of axial sections that are offset from the centerline C. Axial sections 53, 54, and 55 are each sized to contact the interior channel 61. Offset sections 53, and 55 are offset a greater amount than offset section 54. Sections 53, 55 create a greater amount of vibration during rotation than section 54 that causes a smaller amount of vibration. In other embodiments, each of the offsets may be the same, or each may be different depending upon the desired results. The shapes of the offsets may also vary as necessary. Offsets having an elongated surface, such as sections 53 and 55, may impart a greater vibratory force during rotation than a smaller offset surface such as section 54. The ends 58, 59 of the auger 54 may both be positioned on the centerline C of the axis of rotation as illustrated in the embodiment of FIGS. 4 and 5, or one or both ends may be offset from the centerline C as illustrated in FIG. 7.

The interior channel 61 may have a variety of shapes. In the embodiment of FIG. 5, the interior channel 61 has a substantially rectangular shape. In another embodiment, the interior channel 61 has an oval or circular shape. In one embodiment the interior channels 61, 63 are elongated with nearly parallel sides. In one embodiment the interior channels 61, 63 may be constructed with various cross-sectional shapes, including square, flat, tapered, and other shapes known to those skilled in the art.

Figure 8:
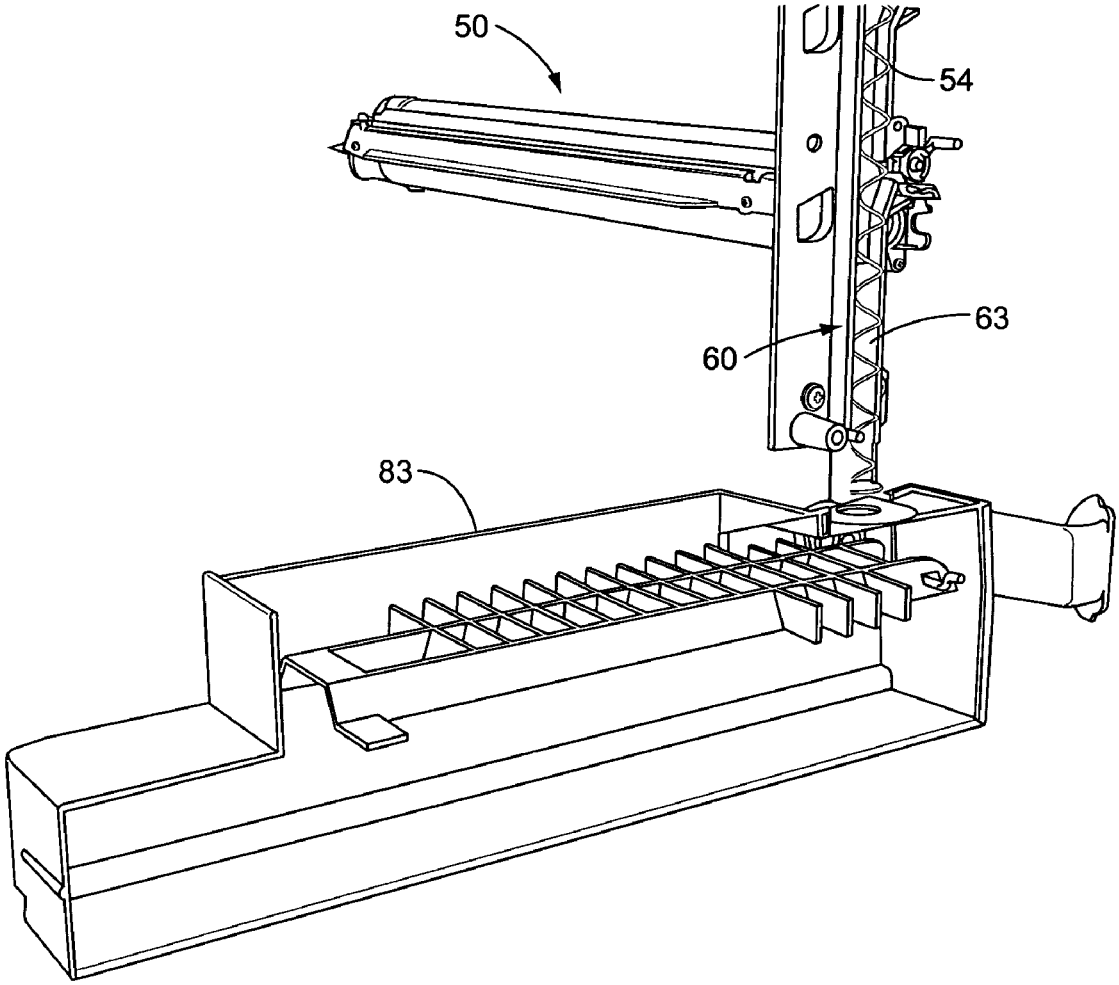
FIG. 8 is a partial cut-away perspective view illustrating a section of the waste toner system according to one embodiment of the present invention.

FIG. 8 illustrates another application for placing the auger 54 within the toner chute 60. In this embodiment, the auger 54 is vertically positioned within the chute 60 and uses gravity for further assistance to move the waste toner. However, testing has indicated that the waste toner may clog and bridge within the vertical chute 60. The auger 54 of the present invention is necessary to reduce or eliminate this problem.

The auger 54 may be constructed in various shapes and sizes of wire or solid shafts having a non-linear shape. In one embodiment the waste toner auger 54 may be formed from a helically-curved wire. In one embodiment the waste toner auger 54 may be a solid shaft helical screw having pitched blades or fins. In one embodiment the waste toner auger 54 may be constructed with various cross-sectional shapes including square, flat, tapered, etc. The auger 54 may be constructed of a deformable material. This causes the cross-sectional shape of the offset to deform during contact with the interior channel 61. The shape then returns towards the normal shape after the offset moves beyond the contact.

Figure 9:
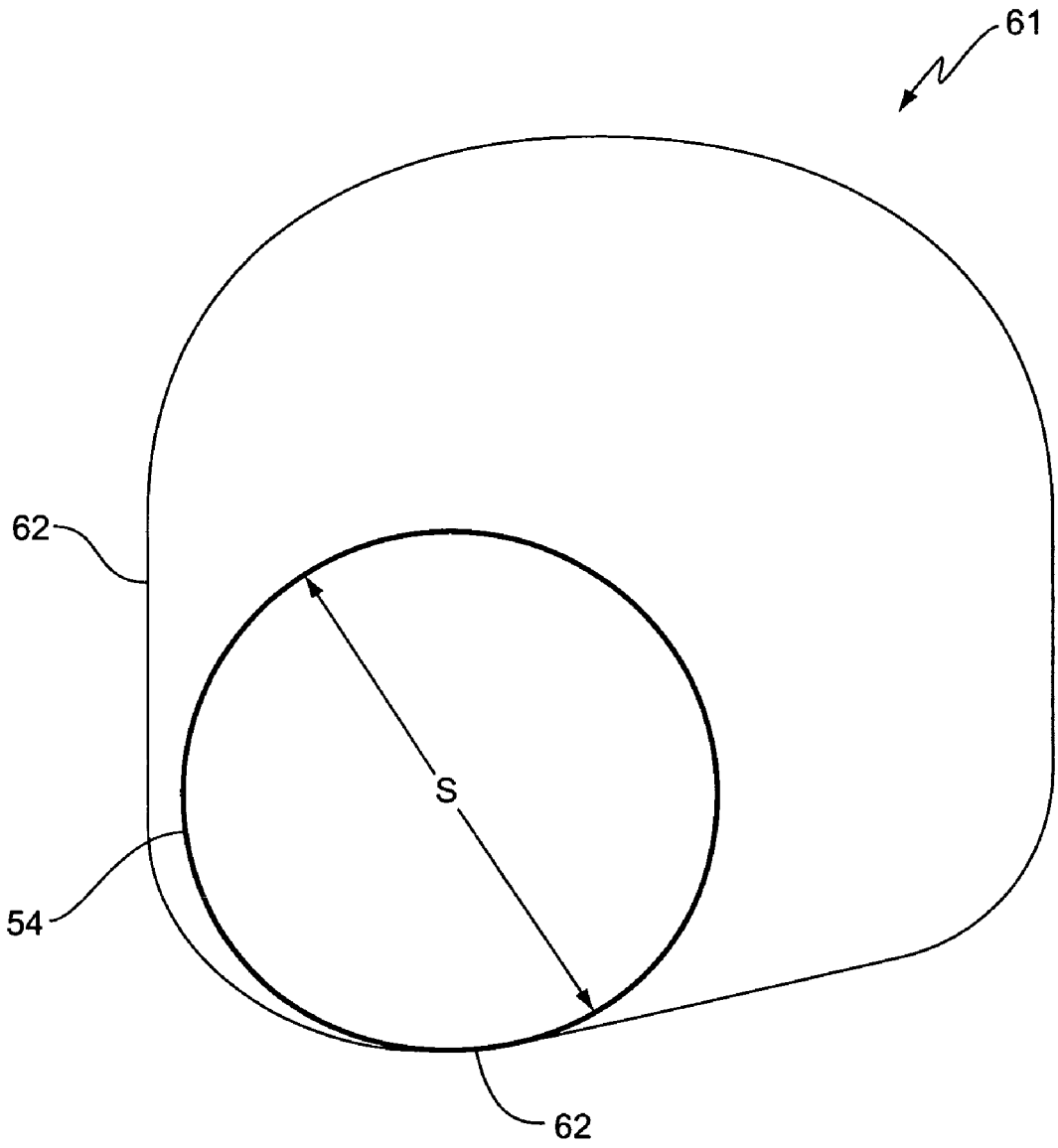
FIG. 9 is a cross-sectional view illustrating an auger within a housing according to one embodiment of the present invention.

The auger 54 may be positioned at a variety of locations within the interior channels 61, 63. In one embodiment, the auger 54 is centered within the channels. In another embodiment as illustrated in FIG. 9, the auger 54 is positioned away from a center of the channel.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A device to move toner in an image forming apparatus, comprising:

a channel with a first width that is sized to contain the toner; and a helical wire auger rotatably positioned within the channel to move the toner along the channel;

the auger having a centerline of an axis of rotation positioned within the channel and an offset forming a sweep envelope, a longitudinal section of the sweep envelope greater than the first width of the channel for the auger to contact the channel during rotation, and an open space formed within the sweep envelope between the wire auger and the centerline such that all points along one complete revolution around the wire auger at the offset are positioned on one side of the centerline of the axis of rotation.

2. The device of claim 1, wherein the auger has a curved configuration with the offset located along a central section between first and second ends of the auger.

3. The device of claim 1, wherein the channel and the axis of rotation of the auger are both substantially linear.

4. The device of claim 1, wherein the auger is constructed of an elastic material that deforms during contact with the channel.

5. The device of claim 1, wherein the channel has a polygonal cross-sectional shape.

6. The device of claim 1, wherein the channel has a circular cross-sectional shape.

7. A device to move toner within an image forming apparatus, comprising:

a housing having a channel with a first width sized to contain the toner; and an auger rotatably positioned within the channel to move the toner along the channel;

the auger having an axis of rotation and an offset positioned from the axis of rotation at an axial position along the auger, the offset having a sweep envelope greater than the remainder of the auger, the auger positioned within the channel with the offset contacting the channel during rotation of the auger, the auger including an internal bore generally in the direction of the axis of rotation;

the auger including a second offset positioned at a second axial position along the auger, the second offset being axially spaced apart from the offset.

8. The device of claim 7, wherein the offset contacts the channel at two points during rotation of the auger.

9. The device of claim 7, wherein the offset has an edge that is substantially parallel with the axis of rotation.

10. The device of claim 7, wherein the auger has a curved configuration with the offset positioned at a central area between first and second ends of the auger.

11. The device of claim 7, wherein the offset is tapered.

12. The device of claim 7, wherein the axis of rotation and the housing are both substantially linear.

13. The device of claim 7, wherein the offset is a different size than the second offset.

14. The device of claim 7, wherein the auger is constructed of an elastic material that deforms during contact with the channel.

15. The device of claim 7, wherein the auger is vertically positioned within the image forming apparatus.

16. A device to move waste toner within an image forming apparatus, comprising:

a toner cartridge having a channel with a first width that is sized to contain the waste toner;

a photoconductive member positioned within the toner cartridge;

an auger rotatably positioned within the channel to move the waste toner along the channel; and the auger having an axis of rotation and an offset extending from the axis of rotation at an axial position along the auger, the offset having a sweep envelope greater than a remainder of the auger, the auger positioned within the channel with the offset contacting the channel during rotation of the auger, and a radius of the auger less than a maximum radius of the sweep envelope;

wherein the axis of rotation is positioned entirely outside the auger at the axial position.

17. A method of moving toner in an image forming apparatus, the method comprising the steps of:

rotating a wire auger with a generally spiral shape and a continuous open space within the spiral within a channel and moving the toner along the channel;

contacting an offset section of the auger against the channel during each auger rotation;

building a mechanical force within the auger;

deforming the offset section against the channel; and continuing rotation of the auger and releasing the mechanical force in the auger.

18. The method of claim 17, further comprising contacting a central section of the channel with the offset.

19. The method of claim 17, further comprising contacting the offset section against the channel twice during each auger rotation.

20. The method of claim 17, further comprising contacting a second offset against the channel at a position that is axially spaced from the offset.

21. The method of claim 20, further comprising imparting a first vibratory force during contact with the offset and a second larger vibratory force during contact with the second offset.

22. The method of claim 17, further comprising the step of rotating the auger at a first speed prior to contacting the channel and rotating the auger at a second speed greater than the first speed immediately after releasing the mechanical force.

* * * * *